US009301625B2

(12) United States Patent
Fiumefreddo et al.

(10) Patent No.: US 9,301,625 B2
(45) Date of Patent: Apr. 5, 2016

(54) HANGER FOR DISPLAYING FLOOR MATS

(71) Applicant: Kraco Enterprises, LLC, Compton, CA (US)

(72) Inventors: John J. Fiumefreddo, Huntington Beach, CA (US); Alexandria R. Hill, Redondo Beach, CA (US); Kenneth A. Gross, Northridge, CA (US)

(73) Assignee: Kraco Enterprises, LLC., Compton, CA (US)

( * ) Notice: Subject to any disclaimer, the term of this patent is extended or adjusted under 35 U.S.C. 154(b) by 0 days.

(21) Appl. No.: 14/515,908

(22) Filed: Oct. 16, 2014

(65) Prior Publication Data

US 2015/0102190 A1 Apr. 16, 2015

Related U.S. Application Data

(60) Provisional application No. 61/891,665, filed on Oct. 16, 2013.

(51) Int. Cl.
*A47F 7/16* (2006.01)
*A47F 5/00* (2006.01)

(52) U.S. Cl.
CPC ..... *A47F 7/16* (2013.01); *A47F 5/0006* (2013.01)

(58) Field of Classification Search
CPC ..... A47F 7/16; A47F 5/0006; B60N 3/04
See application file for complete search history.

(56) References Cited

U.S. PATENT DOCUMENTS

| | | | | |
|---|---|---|---|---|
| 287,085 | A | 10/1883 | Leeds | |
| 3,710,996 | A * | 1/1973 | Smilow et al. | 223/87 |
| 4,718,546 | A * | 1/1988 | Kolton et al. | 206/296 |
| 5,257,694 | A * | 11/1993 | Wallach | 206/286 |
| 6,422,524 | B1 * | 7/2002 | Spagnuolo et al. | 248/307 |
| 6,758,379 | B1 * | 7/2004 | Elwell | 223/85 |
| 7,389,885 | B2 | 6/2008 | Masanek, Jr. | |
| 8,087,520 | B2 | 1/2012 | Milella, Jr. et al. | |
| 9,004,276 | B2 * | 4/2015 | Brown | B65D 85/54 206/335 |
| 2004/0217249 | A1 * | 11/2004 | Eisenbraun | A47F 5/0006 248/323 |

FOREIGN PATENT DOCUMENTS

| | | | | |
|---|---|---|---|---|
| AU | 2013900190 A * | 1/2013 | | A47F 7/16 |
| EP | 2135529 A1 | 12/2009 | | |

* cited by examiner

*Primary Examiner* — Jeanette E Chapman
(74) *Attorney, Agent, or Firm* — Wood, Herron & Evans, LLP

(57) ABSTRACT

A hanger for displaying floor mats includes a main body portion and at least one post extending from the main body portion for receiving at least one floor mat. The hanger further includes a locking member hingedly coupled with the body portion and selectively movable between a first configuration disengaged from the post, and a second configuration engaging the post to capture a floor mat supported on the post.

5 Claims, 6 Drawing Sheets

HANGER FOR DISPLAYING FLOOR MATS

CROSS-REFERENCE

This application claims the benefit of U.S. Provisional Patent Application Ser. No. 61/891,665, filed Oct. 16, 2013, the disclosure of which is expressly incorporated by reference herein in its entirety.

TECHNICAL FIELD

The present invention relates generally to apparatus for displaying products at a point of sale and, more particularly, to a hanger for displaying floor mats.

BACKGROUND

At a point of sale, vehicle floor mats and similar products are generally hung on hangers for display in racks. These hangers are typically of low quality and may be easily broken or damaged do to the relatively heavy weight of the mats that are supported on the hangers. Hangers for suspending these floor mats must therefore be strong and be capable of securing the mats well enough so that they do not become separated, even when subjected to forces experienced during shipping or display. It is of considerable advantage if such hangers can be easily injection molded from plastic and attached to the mats before they are shipped to distributors, as well as reattached at the consumer level in the event that a customer return is required.

SUMMARY

The present invention provides a hanger that facilitates the display of floor mats or similar articles, particularly at a point of sale. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the invention, a floor mat display hanger has at least one protruding post at one or more hanging locations. The one or more posts may be positioned in a manner to distribute the product weight evenly as it is suspended from said hanger. The post may be molded to the hanger and may have a corresponding locking member that secures the product relative to the hanger body. The locking member may be used to capture one or more floor mats therebetween for product display or storage. The locking member may comprise a molded fastening arm that extends from the floor mat hanger and has a stationary gripping member that registers with the protruding post. The post may be furnished with an aperture for receiving this fastening arm, and has at least one detent to cooperate with at least one pawl associated with the stationary gripping member to secure to the hanger body, thereby capturing at least one floor mat therebetween.

Preferably, the hanger includes two protruding posts with corresponding fastening arms associated with a stationary gripping member. The hanger may further include at least one securing member associated with the locking member. In one embodiment, the securing member may include a pin that, when pressed by a thumb or finger into the aperture in the respective post, moves the pawl into engagement with the detent associated with the post, thereby preventing withdrawal of the fastening arm from the hanger body.

One advantage of a hanger in accordance with the present invention is the ease of molding and assembly of the hanger relative to the suspended floor mat in comparison with prior art designs. Another advantage of a hanger in accordance with the invention is improved strength and rigidity that prevents inadvertent damage to the hanger, or detachment of a suspended floor mat from the hanger during shipment or display.

The above and other objects and advantages of the present invention shall be made apparent from the accompanying drawings and the description thereof.

DETAILED DESCRIPTION

Figure 1:
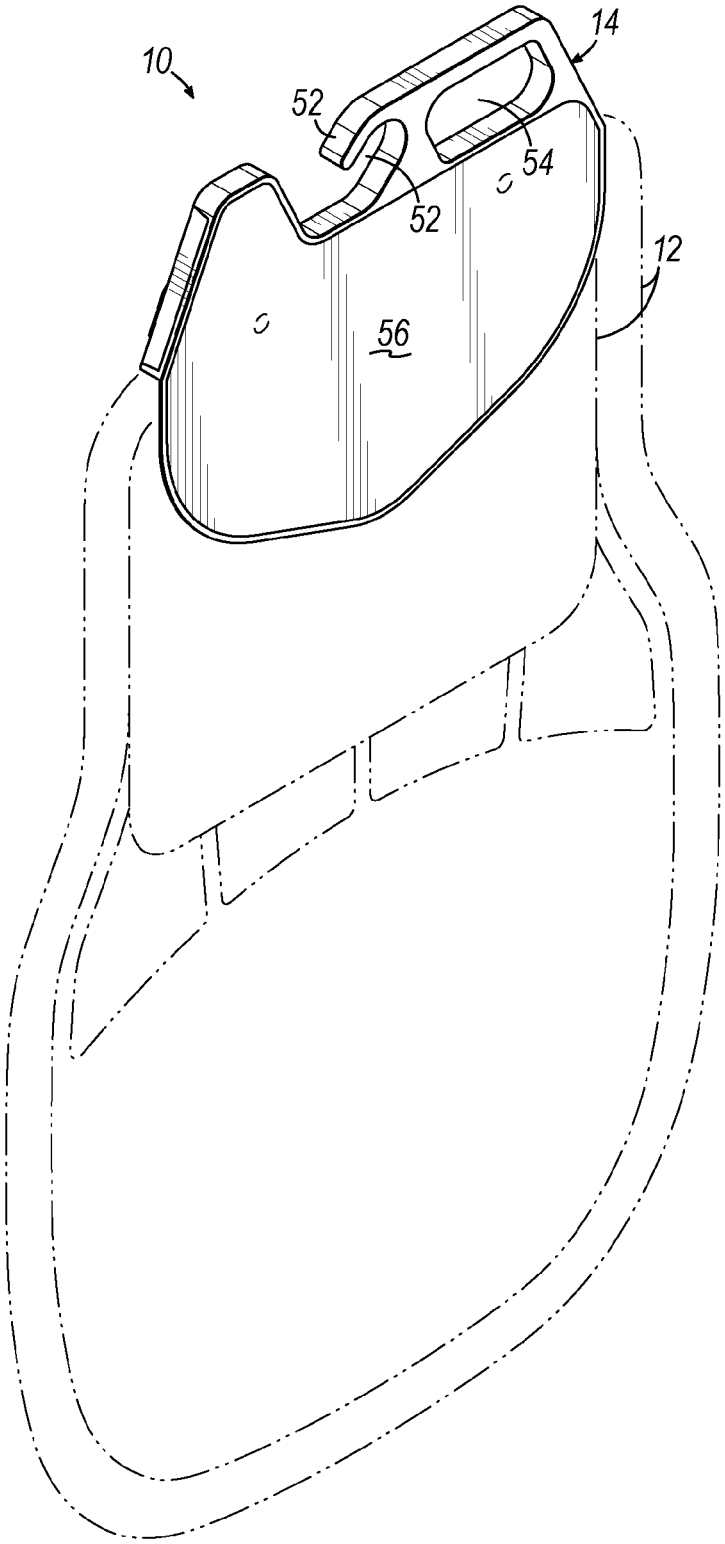
FIG. 1 is a perspective view of an exemplary hanger for displaying floor mats, in accordance with the principles of the present invention.
Figure 2:
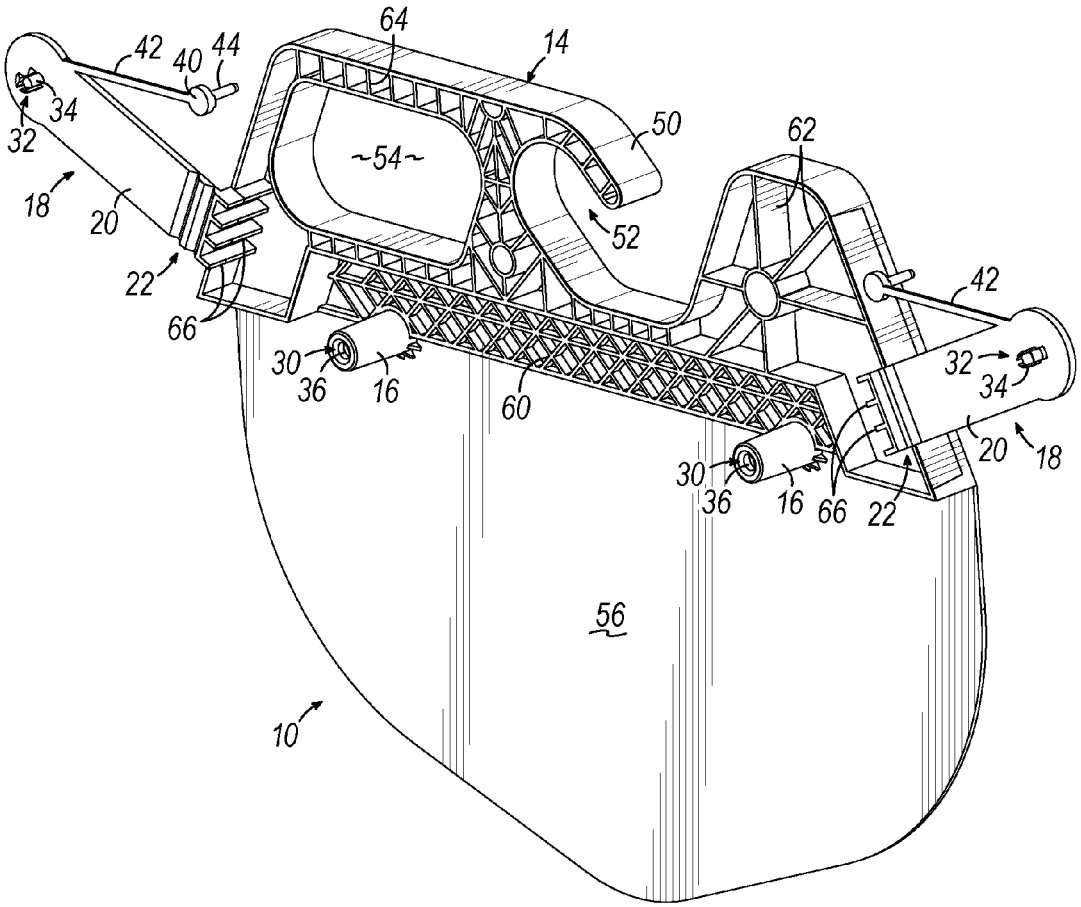
FIG. 2 is a perspective view of the hanger of FIG. 1, viewed from a different angle.

FIGS. 1 and 2 depict an exemplary hanger 10 for displaying floor mats 12 in accordance with the principles of the present invention. The hanger 10 includes a main body portion 14 and at least one post 16 extending outwardly from the main body portion 14 for receiving at least one floor mat 12 thereon. In the embodiment shown, the main body portion 14 has a generally planar shape and the hanger 10 includes first and second posts 16 that extend in directions generally normal to the plane of the main body portion 14. It will be appreciated, however, that the main body portion 14 may comprise various other geometries or configurations, and may include a single post, or more than two posts, as may be desired.

Figure 3:
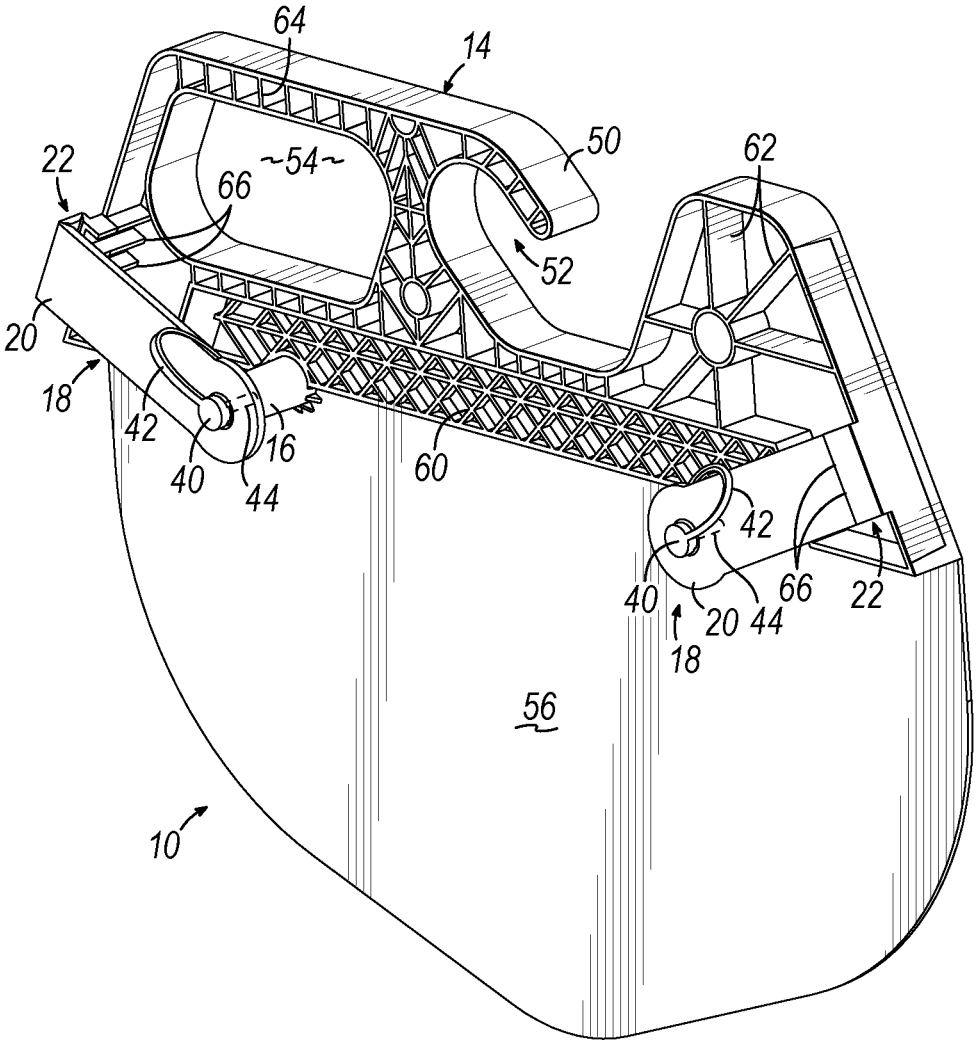
FIG. 3 is a perspective view of the hanger of FIG. 2, illustrated with the locking members in a different position.
Figure 4:
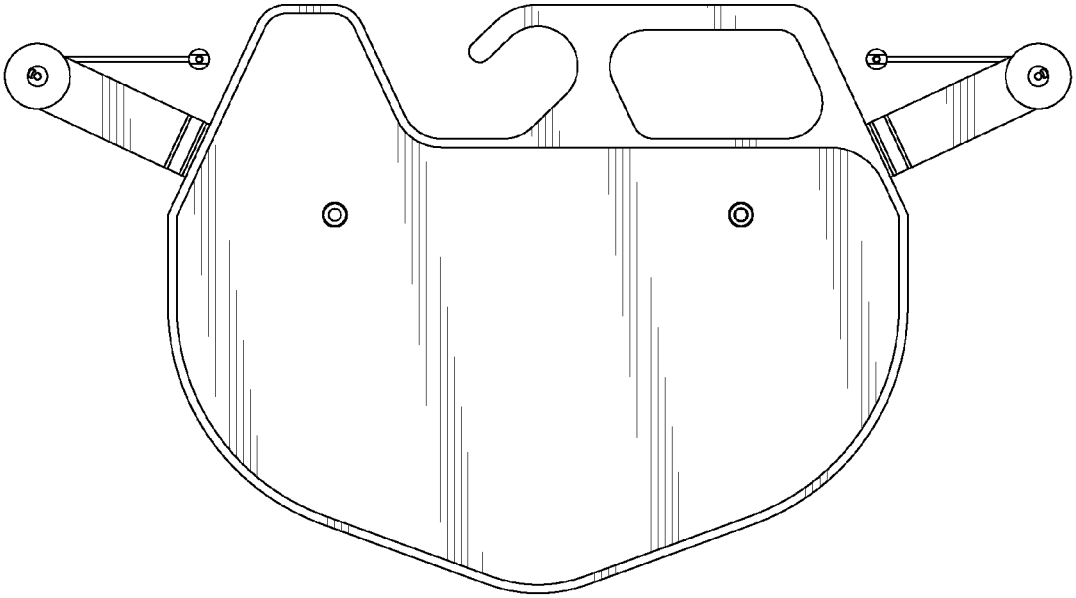
FIG. 4 is a front elevation view of the hanger of FIG. 2.
Figure 5:
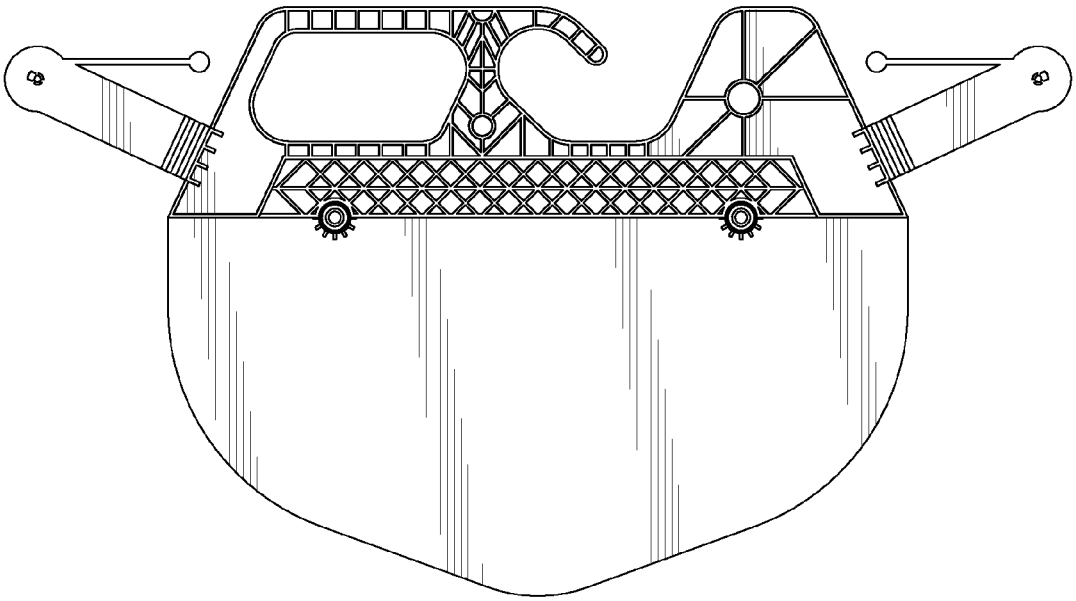
FIG. 5 is a rear elevation view of the hanger of FIG. 2.
Figure 6:
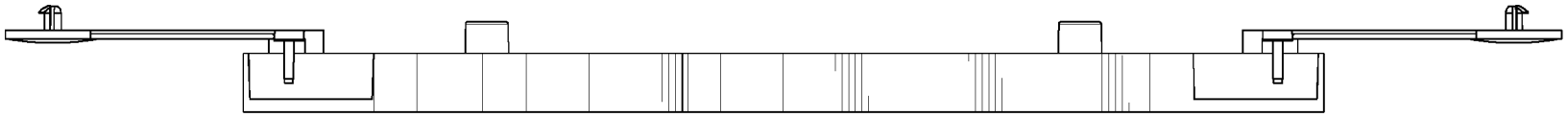
FIG. 6 is a top plan view of the hanger of FIG. 2.
Figure 7:
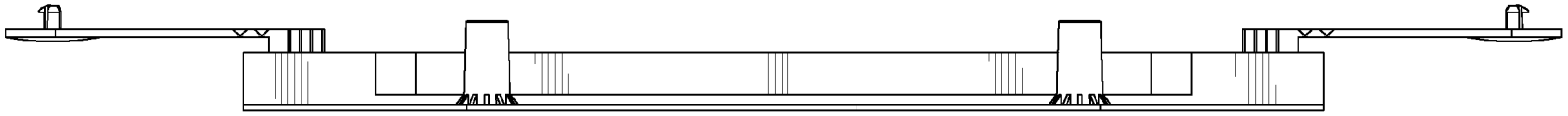
FIG. 7 is a bottom plan view of the hanger of FIG. 2.
Figure 8:
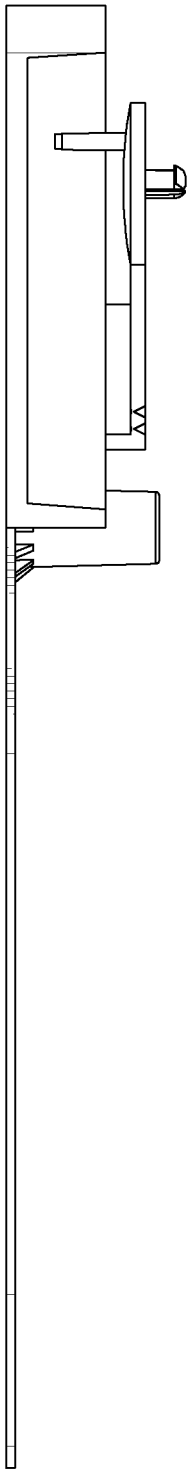
FIG. 8 is a right-side elevation view of the hanger of FIG. 2.
Figure 9:
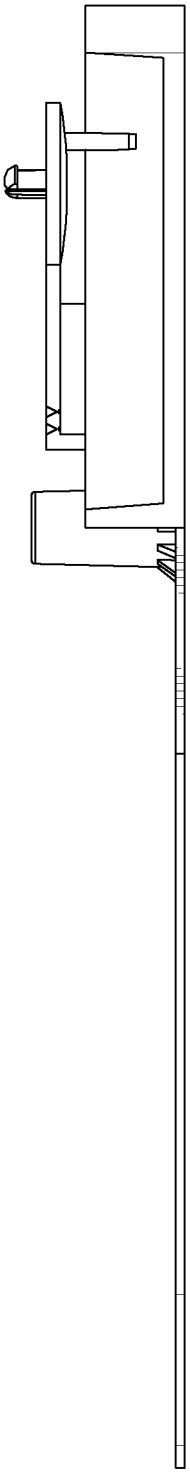
FIG. 9 is a left-side elevation view of the hanger of FIG. 2.

The hanger 10 further includes a locking member 18 associated with each post 16 and being selectively movable between a first configuration disengaged from the associated post 16 (see FIG. 2), and a second configuration engaging the post 16 (see FIG. 3) to thereby capture a floor mat 12 supported on the post 16, between the main body portion 14 and the locking member 18. In the embodiment shown, the hanger 10 includes first and second locking members 18 associated with the first and second posts 16, respectively, wherein the locking members 18 comprise fastening arms 20 that are hingedly coupled with the main body portion 14 for movement about hinge joints 22 between the first and second configurations. The fastening arms 20 and hinge joints 22 may be integrally formed with the main body portion 14, and the hinge joints 22 may comprise living hinges. It will be appreciated however, that the fastening arms 20 and hinge joints 22 may alternatively be formed by various other methods, as may be desired.

Figure 2A:
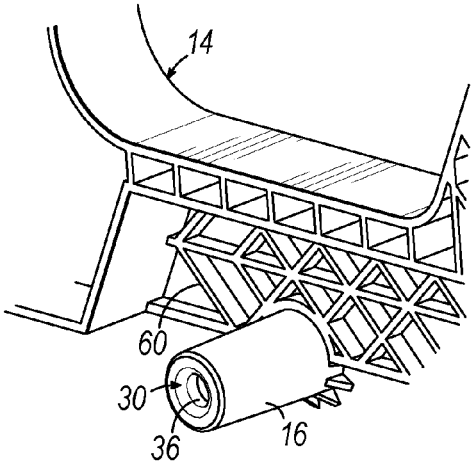
FIG. 2A is an enlarged detail view of a post of the hanger of FIG. 2.
Figure 2B:
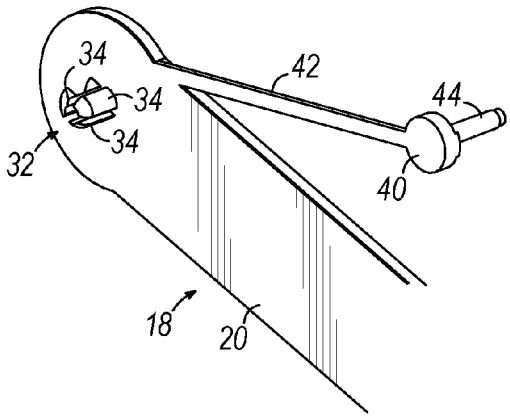
FIG. 2B is an enlarged detail view of a locking member of the hanger of FIG. 2.

With continued reference to FIG. 2 and referring further to FIGS. 2A and 2B, each of the posts 16 of the embodiment shown includes an aperture 30 for receiving a gripping member 32 associated with the respective locking member 18. In the embodiment shown, the gripping member 32 includes at least one pawl 34 sized to be received in the aperture 30 of the respective post 16. Each post 16 further includes a detent 36 within the aperture 30 and configured to cooperate with the pawl 34 of the gripping member 32 when the gripping member 32 is received in the aperture 30 with the locking member 18 in the second configuration engaging the post 16.

The hanger 10 may further include a securing member 40 associated with each locking member 18 and operable to cooperate with the gripping member 32 to secure the locking member 18 in the second configuration. In the embodiment shown, the securing member 40 is coupled with the fastening arm 20 of the locking member 18 by a flexible tether 42, and includes a pin 44 that is engagable with the pawls 34 of the gripping member 32 when the locking member 18 is in the second configuration and the pawls 34 of the gripping member 32 are received in the aperture 30 of the respective post 16. In this configuration, the pin 44 is received between the pawls 34 of the gripping member 32 and causes the pawls 34 to deflect radially outwardly for engagement with the detent 36 of the respective post 16. The securing member 40 thereby maintains engagement of the pawls 34 of the gripping member 32 with the detent 36 of the respective post 16 during shipping, handling, and display of one or more floor mats 12 on the hanger 10.

When it is desired to remove a floor mat 12 from the hanger 10, the securing member 40 may be removed from engagement with the pawls 34 of the gripping member 32 so that the pawls 34 are disengaged from the detent 36 of the post 16 and the locking member 18 can be moved from the second configuration to the first configuration, as depicted in FIG. 2. Likewise, one or more floor mats 12 may be reattached to the hanger 10 by placing the mats 12 into engagement with the respective posts 16, moving the locking members 18 from the first configurations to the second configurations engaged with the respective posts 16, and engaging the pawls 34 of the gripping member 32 with the detents 36 of the posts 16 by moving the securing member 40 into engagement with the pawls 34.

The exemplary hanger 10 may further include a hook arm 50 on the main body portion 14 and defining a recess 52 for engaging a support for suspending the hanger 10 therefrom to facilitate display of a floor mat 12. The hanger 10 may further include an aperture 54 defined in the main body portion 14 and sized to facilitate grasping of the main body portion 14 for easy carrying and handling of the hanger 10 with a floor mat 12 secured thereto. In the embodiment shown, the hanger 10 further includes a stabilizing member 56 extending from the main body portion 14 and being sized and shaped to engage a planar surface of a floor mat 12 supported on the at least one post 16. In the embodiment shown, the stabilizing member 56 comprises a generally planar structure extending generally in a plane parallel to the plane of the main body portion 14. Advantageously, this stabilizing member 56 may provide a surface upon which a label or other information may be provided to facilitate display and sale of a floor mat 12 carried by the hanger 10.

An another aspect, the hanger 10 may be formed by injection molding. In the embodiment shown, the main body portion 14 may include structural ribs 60, 62, 64, 66 to reduce the weight of the hanger 10, while providing strength and rigidity to the hanger 10. It will be appreciated, however, that a hanger in accordance with the principles of the present invention may alternatively be formed by various other methods, as may be desired.

While the present invention has been illustrated by a description of one or more embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A hanger for displaying floor mats, the hanger comprising:

a body;

at least one post extending outwardly from said body, said post adapted to receive at least one floor mat thereon;

a locking member hingedly coupled with said body for movement about a hinge joint;

said locking member selectively movable about said hinge joint between a first configuration disengaged from said post, and a second configuration engaging said post to thereby capture a floor mat supported on said post between said body and said locking member;

an aperture in said post;

a gripping member on said locking member, said gripping member received in said aperture when said locking member is in said second configuration engaging said post;

wherein said gripping member comprises at least one pawl sized to be received in said aperture; and a securing member associated with said locking member, said securing member including a pin engagable with said pawl when said locking member is in said second configuration and said at least one pawl is received in said aperture, to thereby retain said locking member in said second configuration.

2. A hanger for displaying floor mats, the hanger comprising:

a body;

at least one post extending outwardly from said body, said post receiving at least one floor mat thereon;

a locking member hingedly coupled with said body for movement about a hinge joint;

said locking member selectively movable about said hinge joint between a first configuration disengaged from said post, and a second configuration engaging said post to thereby capture a floor mat supported on said post between said body and said locking member; and a securing member associated with said locking member, said securing member operable to retain said locking member in said second configuration.

3. A hanger for displaying floor mats, the hanger comprising:

a body;

at least one post extending outwardly from said body, said post adapted to receive at least one floor mat thereon;

a locking member hingedly coupled with said body for movement about a hinge joint;

said locking member selectively movable about said hinge joint between a first configuration disengaged from said post, and a second configuration engaging said post to thereby capture a floor mat supported on said post between said body and said locking member; and a securing member associated with said locking member, said securing member operable to retain said locking member in said second configuration;

wherein said securing member is tethered to said locking member.

4. The hanger of claim 2, further comprising a hook arm on said body, said hook arm defining a recess for engaging a support for suspending the hanger therefrom for display of a floor mat.

5. The hanger of claim 2, further comprising:

a stabilizing member extending from said body, said stabilizing member sized and shaped to engage a planar surface of a floor mat supported on said at least one post.

* * * * *